US007727444B2

(12) United States Patent
Huang et al.

(10) Patent No.: US 7,727,444 B2
(45) Date of Patent: Jun. 1, 2010

(54) APPARATUS AND METHOD FOR MANUFACTURING NONWOVEN FABRIC

(75) Inventors: Tzu-Hsiang Huang, Taipei (TW); Chao-Chun Peng, Taipei Hsien (TW)

(73) Assignee: Taiwan Textile Research Institute, Taipei Hsien (TW)

( * ) Notice: Subject to any disclaimer, the term of this patent is extended or adjusted under 35 U.S.C. 154(b) by 0 days.

(21) Appl. No.: 12/265,406

(22) Filed: Nov. 5, 2008

(65) Prior Publication Data

US 2009/0169667 A1 Jul. 2, 2009

(30) Foreign Application Priority Data

Dec. 27, 2007 (TW) ..... 96150587 A

(51) Int. Cl.
*B29C 47/00* (2006.01)
*B29C 47/88* (2006.01)

(52) U.S. Cl. ..... 264/211.14; 264/178 F; 264/180; 264/187; 425/71; 425/72.2; 425/382.2; 425/464

(58) Field of Classification Search ..... 425/66, 425/72.2, 382.2, 464, 71; 264/187, 211.14, 264/178 F, 180
See application file for complete search history.

(56) References Cited

U.S. PATENT DOCUMENTS 3,802,817 A 4/1974 Matsuki et al.
4,204,828 A * 5/1980 Peckinpaugh et al. ..... 425/72.2
4,261,943 A * 4/1981 McCorsley, III ..... 264/136
4,869,860 A * 9/1989 Lewis, Jr. ..... 264/180
5,244,723 A * 9/1993 Anderson et al. ..... 264/555
6,013,223 A 1/2000 Schwarz
6,132,661 A * 10/2000 Kurihara et al. ..... 264/210.7
6,183,684 B1 * 2/2001 Lu ..... 264/555
6,197,230 B1 3/2001 Pierre et al.
6,524,521 B1 * 2/2003 Kuroiwa et al. ..... 425/72.2
6,800,226 B1 10/2004 Gerking
2003/0034585 A1 * 2/2003 Locher et al. ..... 264/210.8
2004/0099981 A1 * 5/2004 Gerking ..... 264/103

FOREIGN PATENT DOCUMENTS

JP 4478046 11/1973
WO 04002072 12/2003

* cited by examiner

*Primary Examiner*—Joseph S Del Sole
*Assistant Examiner*—Robert Dye
(74) *Attorney, Agent, or Firm*—J.C. Patents

(57) ABSTRACT

An apparatus includes a spinning nozzle, a fiber drawing device and a water spray device. The spinning nozzle has spinnerets and a spinning solution is filled therein. The spinning solution includes a solvent and a fiber material. The solvent includes N-Methylmorpholine N-Oxide, and the fiber material includes cellulose. The fiber drawing device is disposed under the spinning nozzle and has a gas flow generating device therein for generating a gas flow which is ejected from the top of the fiber drawing device and toward the bottom thereof. The fiber drawing device also has a slit on the top thereof, and the spinning solution from the spinning nozzle would enter the fiber drawing device through the slit. The water spray device is disposed at the slit of the fiber drawing device, and the spinning solution would pass through the water spray device before entering the fiber drawing device.

25 Claims, 2 Drawing Sheets

APPARATUS AND METHOD FOR MANUFACTURING NONWOVEN FABRIC

CROSS-REFERENCE TO RELATED APPLICATION

This application claims the priority benefit of Taiwan application serial no. 96150587, filed on Dec. 27, 2007. The entirety of the above-mentioned patent application is hereby incorporated by reference herein and made a part of specification.

BACKGROUND OF THE INVENTION

1. Field of the Invention

The present invention generally relates to an apparatus and a method for manufacturing man-made fiber products, in particular, to an apparatus and a method for manufacturing non-woven fabric.

2. Description of Related Art

Non-woven fabric is an application of the man-made fibers, and the manufacturing process combines techniques and principles such as plastic, chemical industry, paper making, and spinning. As being not manufactured in the conventional weaving manner such as plain weaving or knitting, the man-made fiber application is called "non-woven fabric". The non-woven fabric is characterized by low cost, moisture absorption, dust proof, and being antistatic etc, and thus has a quite wide application. In agriculture, architecture, people's livelihood, industry, medicine, automobile and other industries, the non-woven fabric is used as the material for filtering, obstructing, moisture absorbing, and other functions.

Usually, during the process of manufacturing the non-woven fabric, firstly a polymer material is spun to fiber yarns, and then the continuous yarns are lapped to form the non-woven fabric. A fiber drawing device is used to stretch the fiber yarn to more elongated yarns. The more elongated yarns may make the lapped non-woven fabric more delicate, and on the other hand, the required polymer material may be reduced, so as to lower the production cost of the non-woven fabric. For example, an apparatus for manufacturing non-woven fabric provided in U.S. Pat. No. 3,802,817 has a fiber drawing device using air as the power. That is, after a spinning solution is sprayed from the spinning nozzle, the spinning solution may enter the fiber drawing device through a slit, so as to stretch to a more elongated single yarn. However, the apparatus cannot be applied to viscose fiber material such as Lyocell material. The reason is that the fiber materials have a high viscosity, and may be adhered to each other and overlapped in the apparatus, not only it is impossible to form the elongated single yarn, but also the spinning solution may be adhered to the slit before entering the slit, and results in the jam of the slit. Therefore, as the non-woven fabric material is developed, it is necessary to modify the conventional method of manufacturing non-woven fabric.

SUMMARY OF THE INVENTION

Accordingly, the present invention is directed to an apparatus for manufacturing non-woven fabric, which is applicable to spin a Lyocell material.

The present invention is also directed to a method for manufacturing non-woven fabric, so as to solve a problem that a viscose fiber material is adhered to each other during the spinning process.

The present invention provides an apparatus for manufacturing non-woven fabric, which includes a spinning nozzle, a fiber drawing device and a water spray device. The spinning nozzle has a plurality of spinnerets and a spinning solution is filled therein. The spinning solution includes a solvent and a fiber material dissolved in the solvent. The solvent includes N-Methylmorpholine N-Oxide (NMMO), and the fiber material includes cellulose. The fiber drawing device is disposed under the spinning nozzle and has a gas flow generating device therein for generating a gas flow which is ejected from the top of the fiber drawing device and toward the bottom thereof. The fiber drawing device also has a slit on the top thereof, and the spinning solution from the spinning nozzle enters the fiber drawing device through the slit. The water spray device is disposed at the slit of the fiber drawing device, and the spinning solution passes through the water spray device before entering the fiber drawing device.

The present invention provides a method for manufacturing non-woven fabric, which includes the following steps. A spinning solution is provided, which includes a solvent and a fiber material dissolved in the solvent. The solvent includes NMMO, and the fiber includes cellulose. Then, a spinning apparatus is provided, which includes a spinning nozzle, a fiber drawing device, and a water spray device. The spinning nozzle has a plurality of spinnerets, and the fiber drawing device is disposed under the spinning nozzle and has a gas flow generating device therein. The fiber drawing device also has a slit on the top thereof, and the water spray device is disposed at the slit of the fiber drawing device. Then, the spinning apparatus is started, the water spray device forms a sprayed water flow at the slit, the gas flow generating device generates a gas flow which is ejected from the top of the fiber drawing device and toward the bottom thereof, the water sprayed by the water spray device forms vapor in the fiber drawing device after entering the slit. Next, the spinning solution is filled in the spinning nozzle, and sprayed from the spinning nozzle, then passes through the water spray device, and enters the fiber drawing device, so as to be stretched to yarns in the fiber drawing device.

In an embodiment of the present invention, the water sprayed by the water spray device is in a form of a plurality of water columns, a plurality of sprays, or at least one continuous water curtain.

In an embodiment of the present invention, a distance between the spinning nozzle and the fiber drawing device is 0-1 m.

In an embodiment of the present invention, a length of the fiber drawing device is 0.3-1 m.

In an embodiment of the present invention, the spinnerets on the spinning nozzle are arranged in a matrix or interlaced.

In an embodiment of the present invention, a width of the spinning nozzle is larger than that of the slit.

In an embodiment of the present invention, the width of the spinning nozzle is 2-10 cm.

In an embodiment of the present invention, a width of the slit is 0.5-5 cm.

In an embodiment of the present invention, an inlet wind velocity of the gas flow generating device in the fiber drawing device is 5-30 m/s.

In an embodiment of the present invention, an outlet wind velocity of the gas flow generating device in the fiber drawing device is 15-80 m/s.

In an embodiment of the present invention, a squeeze amount of the spinning nozzle is 0.1-20 g/spinneret/minute.

In an embodiment of the present invention, a water spray amount of the water spray device is 100-2000 cm/minute.

In an embodiment of the present invention, in the apparatus for manufacturing non-woven fabric, the water sprayed by the water spray device enters the slit to form vapor in the fiber drawing device.

In an embodiment of the present invention, the apparatus for manufacturing non-woven fabric further includes a carrying device, disposed on the bottom of the fiber drawing device, such that the spinning solution forms a net on the carrying device after passing through the fiber drawing device.

In an embodiment of the present invention, in the method for manufacturing non-woven fabric, the spinning solution forms a net on the bottom of the fiber drawing device after being stretched to yarns in the fiber drawing device In the apparatus and the method for manufacturing non-woven fabric of the present invention, the water spray device is adopted, so as to solve the problem in the conventional art that the spinning solution including NMMO and cellulose cannot enter the fiber drawing device through the slit for being stretched, and to prevent the spinning solution from being adhered to the slit. In addition, the method for manufacturing non-woven fabric provided by the present invention enables the non-woven fabric have a delicate surface, and also reduces the using amount of the spinning solution to lower the production cost.

In order to have a further understanding of the above and other objectives, features, and advantages of the present invention, a detailed description is given below with the preferred embodiment and the accompanying drawings.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
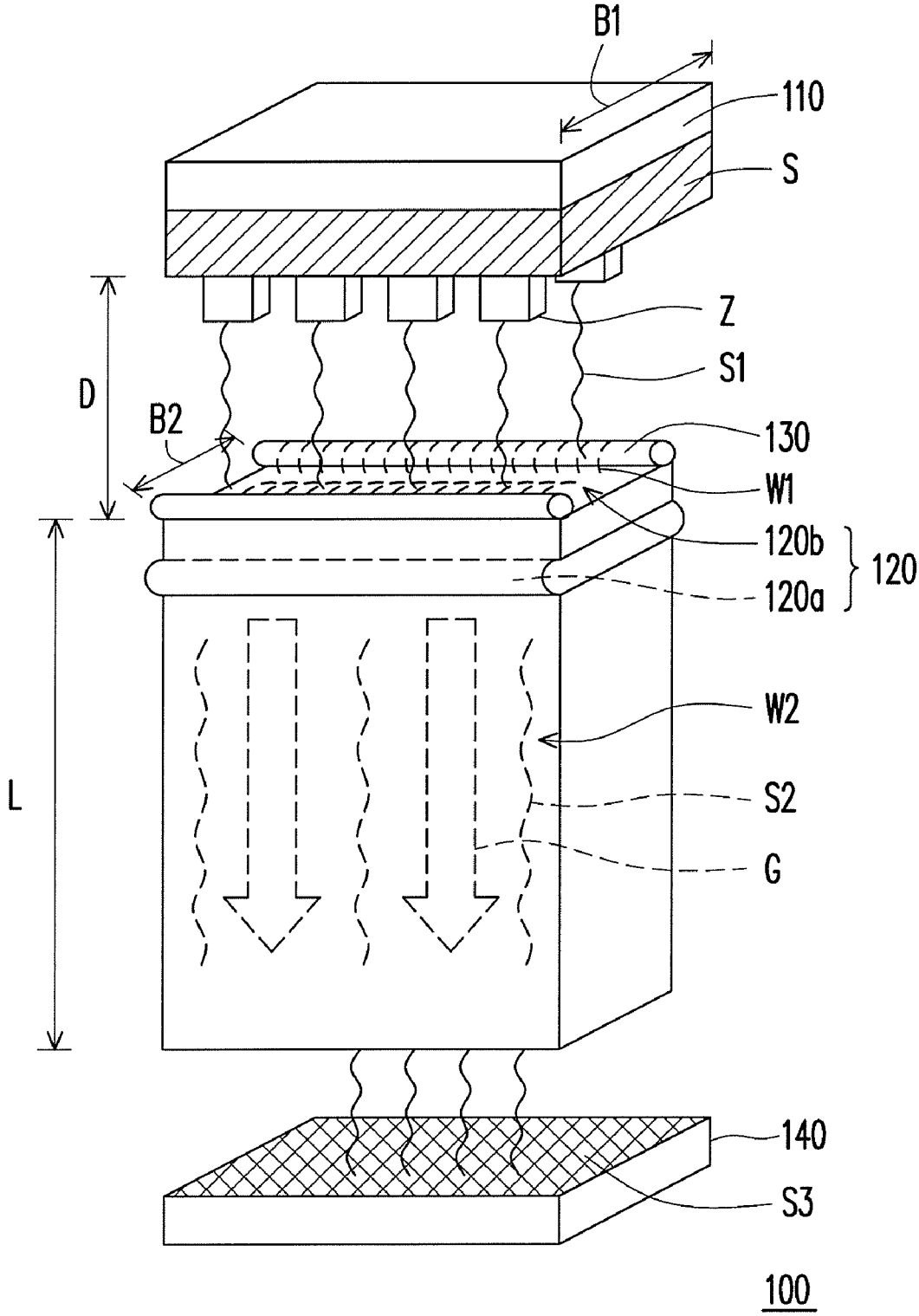
FIG. 1 is a schematic three dimensional view of an apparatus for manufacturing non-woven fabric according to an embodiment of the present invention.

Reference will now be made in detail to the present embodiments of the invention, examples of which are illustrated in the accompanying drawings. Wherever possible, the same reference numbers are used in the drawings and the description to refer to the same or like parts.

FIG. 1 is a schematic three dimensional view of an apparatus for manufacturing non-woven fabric according to an embodiment of the present invention.

Referring to FIG. 1, an apparatus 100 for manufacturing non-woven fabric includes a spinning nozzle 110, a fiber drawing device 120 and a water spray device 130. The spinning nozzle 110 has a spinning solution S including a solvent and a fiber material dissolved in the solvent, in which the solvent includes N-Methylmorpholine N-Oxide (NMMO), and the fiber material includes cellulose. The spinning nozzle 110 has a plurality of spinnerets Z, such that the spinning solution S is squeezed from the spinnerets Z. The amount of the spinning solution S squeezed from the spinning nozzle 110 is, for example, 0.1-20 g/spinneret/minute. In this embodiment, a width B1 of the spinning nozzle 110 is, for example, 2-10 cm, and the spinnerets Z are arranged in a matrix, but the present invention is not limited thereto. In another embodiment, the spinnerets may be interlaced.

The fiber drawing device 120 is disposed under the spinning nozzle 110, and a distance D between the two is, for example, 0-1 m. A length L of the fiber drawing device 120 is, for example, 0.3-1 m. The fiber drawing device 120 has a gas flow generating device 120*a* therein, for generating a gas flow G which is ejected from a top of the fiber drawing device 120 and toward a bottom thereof. An inlet wind velocity of the gas flow generating device 120*a* is, for example, 5-30 m/s, and an outlet wind velocity is, for example, 15-80 m/s. The fiber drawing device 120 further has a slit 120*b* on the top thereof, and the spinning solution S1 from the spinning nozzle 110 may enter the fiber drawing device 120 through the slit 120*b*. A width B2 of the slit 120*b* is, for example, 0.5-5 cm. It should be noted that in this embodiment, the width B1 of the spinning nozzle 110 is, for example, larger than the width B2 of the slit 120*b*.

The water spray device 130 is disposed at the slit 120*b* of the fiber drawing device 120. The spinning solution S1 passes through the water spray device 130 before entering the fiber drawing device 120, and a water spray amount W1 of the water spray device 130 is, for example, 100-2000 cm/minute. It should be noted that in this embodiment, the water spray device 130 is bilaterally disposed, but the present invention is not limited thereto, in another embodiment, the water spray device may be unilaterally disposed, that is, only one row of water spray device exists. In addition, the water sprayed by the water spray device 130 is in a form of a plurality of water columns, a plurality of sprays, or at least one continuous water curtain. In other words, if the outlet on the water spray device 130 is a plurality of outlets, the sprayed water may be in a form of a plurality of water columns or a plurality of sprays. If the outlet on the water spray device 130 is a single slit outlet, the sprayed water may be in a form of at least one continuous water curtain.

In this embodiment, the apparatus 100 for manufacturing non-woven fabric further includes a carrying device 140, disposed on the bottom of the fiber drawing device 120, such that the spinning solution S2 forms a net S3 on the carrying device 140 after passing through the fiber drawing device 120.

Figure 2:
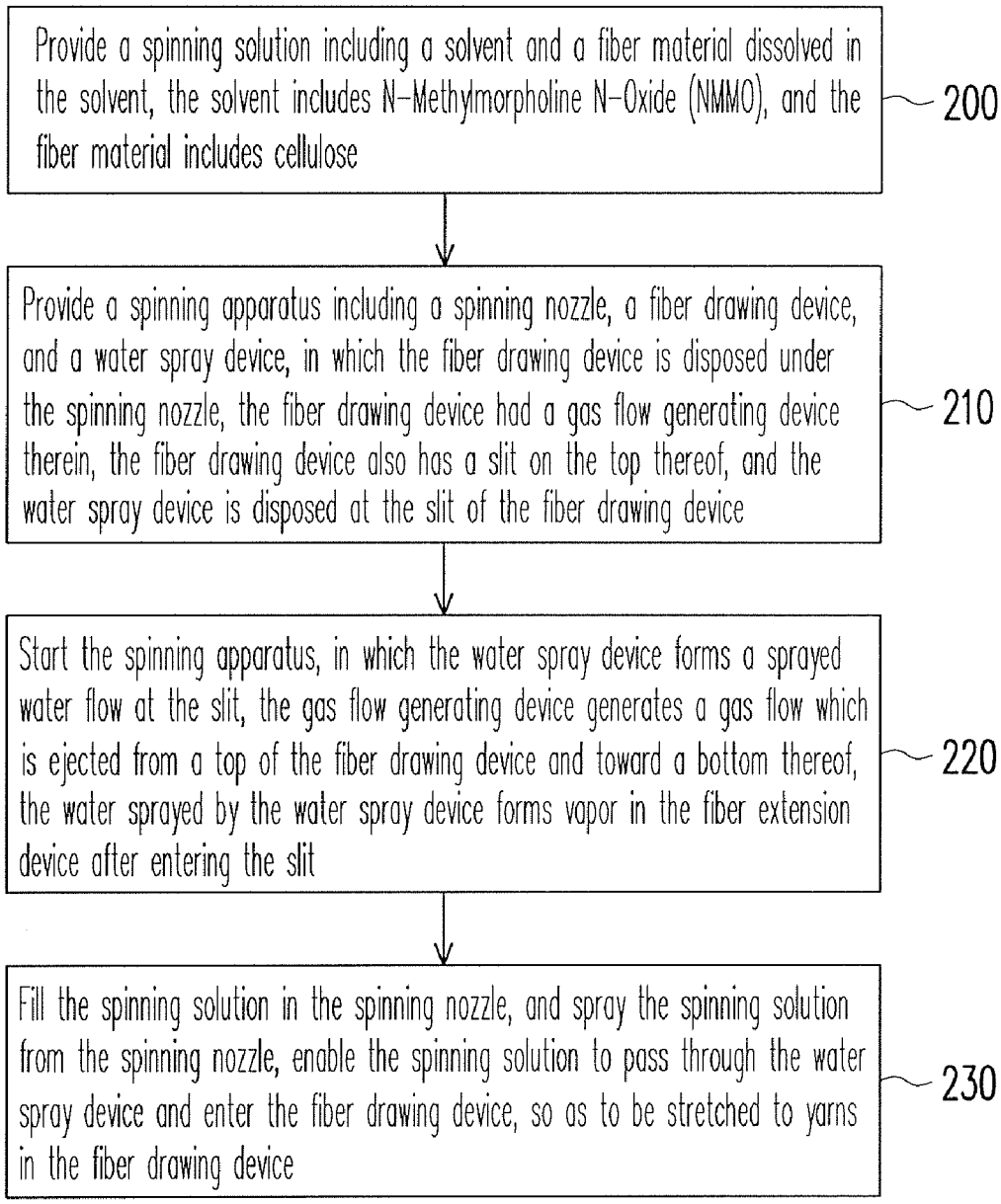
FIG. 2 is a flow chart of processes of a method for manufacturing non-woven fabric according to an embodiment of the present invention.

The method for manufacturing non-woven fabric by using the apparatus for manufacturing non-woven fabric is described as follows. FIG. 2 is a flow chart of processes of a method for manufacturing non-woven fabric according to an embodiment of the present invention.

Referring to FIG. 2, firstly Step 200 is performed. A spinning solution is provided, in which the spinning solution includes a solvent and a fiber material dissolved in the solvent, the solvent includes NMMO, and the fiber material includes cellulose.

Referring to FIGS. 1 and 2 together, next, Step 210 is performed. A spinning apparatus 100 is provided, which includes a spinning nozzle 110, a fiber drawing device 120, and a water spray device 130. The spinning nozzle 110 has a plurality of spinnerets Z. The fiber drawing device 120 is disposed under the spinning nozzle 110, the fiber drawing device 120 has a gas flow generating device 120*a* therein, and the fiber drawing device 120 has a slit 120*b* on the top thereof. The water spray device 130 is disposed at the slit 120*b* of the fiber drawing device 120. In this embodiment, a width B1 of the spinning nozzle 110 is, for example, 2-10 cm, and the spinnerets Z are arranged in a matrix, but the present invention is not limited thereto, the spinnerets Z may be interlaced. A distance D between the spinning nozzle 110 and the fiber drawing device 120 is, for example, 0-1 m. A length L of the fiber drawing device 120 is, for example, 0.3-1 m. A width B2 of the slit 120*b* is, for example, 0.5-5 cm. It should be noted that the width B1 of the spinning nozzle 110 is, for example, larger than the width B2 of the slit 120*b*. In addition, the water spray device 130 is bilaterally disposed, but the present invention is not limited thereto, in another embodiment, the water spray device may be unilaterally disposed, that is, only one row of water spray device exists.

Next, Step 220 is performed. The spinning apparatus 100 is started, the water spray device 130 may form a sprayed water flow W1 at the slit 120*b*, the gas flow generating device 120*a* may generate a gas flow G from a top of the fiber drawing device 120 toward a bottom thereof, and the water W1 from the water spray device 130 may form vapor W2 in the fiber drawing device 120 after entering the slit 120*b*. In this embodiment, a water spray amount W1 of the water spray device 130 is, for example, 100-2000 cm/minute, an inlet wind velocity of the gas flow generating device 120*a* is, for example, 5-30 m/s, and an outlet wind velocity is, for example, 15-80 m/s. The sprayed water flow W1 formed by the water spray device 130 may be in a form of a plurality of water columns, a plurality of sprays, or at least one continuous water curtain.

Next, Step 230 is performed. The spinning solution S is filled in the spinning nozzle 110, the spinning solution S1 is sprayed from the spinning nozzle 110, passes through the water spray device 130, and enters the fiber drawing device 120, so as to be stretched to yarns in the fiber drawing device 120. In this embodiment, a width of the spinning nozzle 110 is, for example, 2-10 cm, and a squeeze amount of the spinning nozzle 110 is, for example, 0.1-20 g/spinneret/minute. In addition, the spinning solution S2 forms a net S3 on the bottom of the fiber drawing device 120 after being stretched to yarns in the fiber drawing device 120.

In this embodiment, the water spray device 130 may effectively overcome the problem in the conventional apparatus that the spinning solution is adhered to the slit to jam the slit. More particularly, before entering the fiber drawing device 120, the spinning solution S1 may contact with the sprayed water flow W1 from the water spray device 130. The water W1 may displace a part of the solvent in the spinning solution S1, and may also lower the temperature of the spinning solution S1, thus being helpful to lower the viscosity of the spinning solution S1, such that the spinning solution S1 increasingly becomes yarns and may not be adhered to a mass. Therefore, the spinning solution S1 may enter the fiber drawing device 120 for being stretched. Further, the water spray device 130 assists the spinning solution to form the elongated and single yarn. In detail, the sprayed water flow W1 may also enter slit the 120*b*, and form the vapor W2 in the fiber drawing device 120. The vapor W2 and the gas flow G are helpful to fully stretch the spinning solution S2, so as to form the elongated yarns. In addition, the vapor W2 and the gas flow G may increasingly cure the elongated yarns, such that the yarns has the characteristics of a single yarn, and the non-woven fabric in the form of the net S3 is delicate and has better uniformity.

To sum up, the present invention at least has the following advantages.

1. In the apparatus and method for manufacturing non-woven fabric of the present invention, the water spray device is used, such that the spinning solution increasingly becomes yarns and may not be adhered to a mass.

2. In the apparatus and method for manufacturing non-woven fabric of the present invention, the sprayed water flow may prevent the spinning solution from being adhered to the slit, such that the spinning solution is guided to the fiber drawing device.

3. In the apparatus and method for manufacturing non-woven fabric of the present invention, a mixed flow of the vapor and the gas flow enables the spinning solution become the elongated and single yarn.

4. When manufacturing non-woven fabric by adopting the apparatus and method of the present invention, the production cost may be reduced as the elongated and single spin may be obtained.

5. The non-woven fabric manufactured by adopting the apparatus and method of the present invention is delicate and has better uniformity.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An apparatus for manufacturing non-woven fabric, comprising:

a spinning nozzle, comprising a plurality of spinnerets, wherein a spinning solution comprising a solvent and a fiber material dissolved in the solvent is filled in the spinning nozzle, the spinning solution comprises N-Methylmorpholine N-Oxide (NMMO), and the fiber material comprises cellulose;

a fiber drawing device, disposed under the spinning nozzle, wherein the fiber drawing device comprises a gas flow generating device therein for generating a gas flow which is ejected from a top of the fiber drawing device and toward a bottom thereof, the fiber drawing device also comprises a slit on the top thereof, and the spinning solution from the spinning nozzle enters the fiber drawing device through the slit; and a water spray device, disposed at the slit of the fiber drawing device, wherein the spinning solution passes through the water spray device before entering the fiber drawing device, wherein the water sprayed by the water spray device is by a single slit outlet in the form of two continuous water curtains respectively at two sides of the slit of the fiber drawing device.

2. The apparatus for manufacturing non-woven fabric according to claim 1, wherein the water sprayed by the water spray device enters the slit to form vapor in the fiber drawing device.

3. The apparatus for manufacturing non-woven fabric according to claim 1, wherein a distance between the spinning nozzle and the fiber drawing device is 0-1 m.

4. The apparatus for manufacturing non-woven fabric according to claim 1, wherein a length of the fiber drawing device is between 0.3-1 m.

5. The apparatus for manufacturing non-woven fabric according to claim 1, wherein the spinnerets on the spinning nozzle are arranged in a matrix or interlaced.

6. The apparatus for manufacturing non-woven fabric according to claim 1, wherein a width of the spinning nozzle is larger than that of the slit.

7. The apparatus for manufacturing non-woven fabric according to claim 6, wherein the width of the spinning nozzle is 2-10 cm.

8. The apparatus for manufacturing non-woven fabric according to claim 5, wherein a width of the slit is 0.5-5 cm.

9. The apparatus for manufacturing non-woven fabric according to claim 1, wherein an inlet wind velocity of the gas flow generating device in the fiber drawing device is 5-30 m/s.

10. The apparatus for manufacturing non-woven fabric according to claim 1, wherein an outlet wind velocity of the gas flow generating device in the fiber drawing device is 15-80 m/s.

11. The apparatus for manufacturing non-woven fabric according to claim 1, wherein a squeeze amount of the spinning nozzle is 0.1-20 g/spinneret/minute.

12. The apparatus for manufacturing non-woven fabric according to claim 1, wherein a water spray amount of the water spray device is 100-2000 cm/minute.

13. The apparatus for manufacturing non-woven fabric according to claim 1, further comprising a carrying device, disposed on the bottom of the fiber drawing device, such that the spinning solution forms a net on the carrying device after passing through the fiber drawing device.

14. A method for manufacturing non-woven fabric, comprising:

providing a spinning solution, wherein the spinning solution comprises a solvent and a fiber material dissolved in the solvent, the solvent comprises N-Methylmorpholine N-Oxide (NMMO), and the fiber material comprises cellulose;

providing a spinning apparatus comprising a spinning nozzle, a fiber drawing device and a water spray device, wherein the spinning nozzle comprises a plurality of spinnerets, the fiber drawing device is disposed under the spinning nozzle, the fiber drawing device comprises a gas flow generating device therein, the fiber drawing device also comprises a slit on the top thereof, and the water spray device is disposed at the slit of the fiber drawing device;

starting the spinning apparatus, wherein the water spray device forms a sprayed water flow at the slit, the gas flow generating device generates a gas flow which is ejected from a top of the fiber drawing device and toward a bottom thereof, and the water sprayed by the water spray device forms vapor in the fiber drawing device after entering the slit;

filling the spinning solution in the spinning nozzle; and spraying the spinning solution from the spinning nozzle, enabling the spinning solution to pass through the water spray device and enter the fiber drawing device, so as to be stretched to yarns in the fiber drawing device, wherein the sprayed water flow formed by the water spray device is by a single slit outlet in the form of two continuous water curtains respectively at two sides of the slit of the fiber drawing device.

15. The method for manufacturing non-woven fabric according to claim 14, wherein a distance between the spinning nozzle and the fiber drawing device is 0-1 m.

16. The method for manufacturing non-woven fabric according to claim 14, wherein a length of the fiber drawing device is 0.3-1 m.

17. The method for manufacturing non-woven fabric according to claim 14, wherein the spinnerets on the spinning nozzle are arranged in a matrix or interlaced.

18. The method for manufacturing non-woven fabric according to claim 14, wherein a width of the spinning nozzle is larger than that of the slit.

19. The method for manufacturing non-woven fabric according to claim 18, wherein the width of the spinning nozzle is 2-10 cm.

20. The method for manufacturing non-woven fabric according to claim 18, wherein a width of the slit is 0.5-5 cm.

21. The method for manufacturing non-woven fabric according to claim 14, wherein an inlet wind velocity of the gas flow generating device in the fiber drawing device is 5-30 m/s.

22. The method for manufacturing non-woven fabric according to claim 14, wherein an outlet wind velocity of the gas flow generating device in the fiber drawing device is 15-80 m/s.

23. The method for manufacturing non-woven fabric according to claim 14, wherein a squeeze amount of the spinning nozzle is 0.1-20 g/spinneret/minute.

24. The method for manufacturing non-woven fabric according to claim 14, wherein a water spray amount of the water spray device is 100-2000 cm/minute.

25. The method for manufacturing non-woven fabric according to claim 14, wherein the spinning solution forms a net on the bottom of the fiber drawing device after being stretched to yarns in the fiber drawing device.

* * * * *